US007526879B2

(12) United States Patent
Bae et al.

(10) Patent No.: US 7,526,879 B2
(45) Date of Patent: May 5, 2009

(54) DRUM WASHING MACHINE AND CLOTHES DRYER USING PELTIER THERMOELECTRIC MODULE

(75) Inventors: Sun Cheol Bae, Masan-si (KR); Ja In Koo, Changwon-si (KR); Jin Seok Hu, Masan-si (KR); Yang Hwan Kim, Busan (KR)

(73) Assignee: LG Electronics Inc., Seoul (KR)

( * ) Notice: Subject to any disclaimer, the term of this patent is extended or adjusted under 35 U.S.C. 154(b) by 217 days.

(21) Appl. No.: 11/591,471

(22) Filed: Nov. 2, 2006

(65) Prior Publication Data

US 2007/0101602 A1 May 10, 2007

(30) Foreign Application Priority Data

Nov. 4, 2005 (KR) ..... 10-2005-0105595
Nov. 4, 2005 (KR) ..... 10-2005-0105596

(51) Int. Cl.
*F26B 21/06* (2006.01)

(52) U.S. Cl. ..... 34/596; 34/601; 34/602; 34/239

(58) Field of Classification Search ..... 34/90, 34/601, 602, 239, 242, 275, 596; 68/139, 68/142; 134/26, 30
See application file for complete search history.

(56) References Cited

U.S. PATENT DOCUMENTS 2,660,806 A * 12/1953 Whitesel ..... 34/77
2,676,418 A * 4/1954 Shewmon ..... 34/77
2,779,172 A * 1/1957 Lindenblad ..... 62/3.4
2,886,618 A * 5/1959 Goldsmid ..... 136/204
3,036,383 A * 5/1962 Edwards ..... 34/76
4,413,425 A * 11/1983 Candor ..... 34/251
4,516,331 A * 5/1985 Yamauchi et al. ..... 34/77
4,621,438 A * 11/1986 Lanciaux ..... 34/77
5,315,765 A * 5/1994 Holst et al. ..... 34/260
5,343,632 A * 9/1994 Dinh ..... 34/507
5,353,519 A * 10/1994 Kanamaru et al. ..... 34/92
5,724,750 A * 3/1998 Burress ..... 34/267
6,088,932 A * 7/2000 Adamski et al. ..... 34/274
6,324,771 B1 * 12/2001 McAllister et al. ..... 34/595
6,418,728 B1 * 7/2002 Monroe ..... 62/3.2
6,877,248 B1 * 4/2005 Cross et al. ..... 34/275
7,222,439 B2 * 5/2007 Paintner ..... 34/73
2004/0117919 A1 * 6/2004 Conrad et al. ..... 8/137
2006/0137214 A1 * 6/2006 Achenbach ..... 34/468
2006/0168840 A1 * 8/2006 Paintner ..... 34/131
2006/0225468 A1 * 10/2006 Hong ..... 68/20
2008/0078099 A1 * 4/2008 Schulz et al. ..... 34/470
2008/0206455 A1 * 8/2008 Sonobe et al. ..... 427/162

* cited by examiner

*Primary Examiner*—S. Gravini
(74) *Attorney, Agent, or Firm*—Birch, Stewart, Kolasch & Birch, LLP

(57) ABSTRACT

A drum washing machine and a clothes dryer equipped with a thermoelectric module are disclosed. The thermoelectric module includes a heat absorption side and a heat dissipation side which absorbs and dissipates heat at a junction between two dissimilar metals depending on direction of current flow through the junction. The heat absorption side is disposed at a hot air flowing passage. Accordingly, the drying apparatus can increase energy efficiency with minor structural modification and becomes environmentally friendly unlike a conventional drying apparatus using a heat pump.

10 Claims, 10 Drawing Sheets

DRUM WASHING MACHINE AND CLOTHES DRYER USING PELTIER THERMOELECTRIC MODULE

This application claims the benefit of Korean Patent Applications Nos. 10-2005-0105595, filed on Nov. 4, 2005 and 10-2005-0105596, filed on Nov. 4, 2005 which are hereby incorporated by reference as if fully set forth herein.

BACKGROUND OF THE INVENTION

1. Field of the Invention

The present invention relates to a drying apparatus, and more particularly to a drum washing machine and a clothes dryer using a thermoelectric module.

2. Discussion of the Related Art

In general, there are a drum washing machine, a clothes dryer and the like as apparatuses for drying clothes.

A drum washing machine performs a washing process by rotating a drum to repeatedly lift and drop clothes, and a drying process by blowing hot air heated by a heater into the drum to evaporate water in dehydrated clothes.

A clothes dryer is an apparatus for drying wet objects by blowing hot air heated by a heater into a drum. The clothes dryer is classified into a vented gas clothes dryer and a condensing clothes dryer according to a method of processing wet air generated when drying the wet objects.

The vented gas clothes dryer is configured to discharge the wet air flowing out of the drum. The condensing clothes dryer is configured to remove water by condensing the wet air flowing out of the drum in a condenser and supply water-removed dry air into the drum for re-circulation.

Meanwhile, when purchasing electric home appliances, consumers consider convenient function, stylish design, reasonable price and the like. Besides, the consumers prudently consider an energy consumption efficiency grade. The energy consumption efficiency grade consists of 1~5th grade, and the 1st grade product is the best energy-saving product. A yellow grade label is attached to a front or side face of the product to be easily identified by the consumers. The 1st grade product saves about 30~40% more energy than the 5th one. Because the easiest way for the consumers to save energy is to choose the energy efficient products, manufactures will strive to develop energy saving technologies if the consumers prefer to buy the energy efficient products.

However, the conventional drying apparatus has a shortcoming that energy efficiency is low and drying time is long.

Accordingly, an energy efficient drying apparatus using a heat pump has been recently developed.

However, the drying apparatus using the heat pump is necessarily equipped with a compressor for constituting a heat pump cycle, which causes problems of high costs and noise. Also, because the heat pump cycle structurally occupies large space, overall size of the product becomes large and weight becomes heavy.

Further, because of the WEEE (Waste of Electrical and Electronic Equipment) for the purpose of making producers of electrical and electronic equipment responsible for the environmental impact of their products, especially when they become waste, and ROHS (Restriction of Hazardous Substances) environmental regulations, the drying apparatus using the heat pump has problems that cost of disposing thereof is increased and only environmentally friendly refrigerant must be used.

In case of the conventional condensing drying apparatus, because it is additionally equipped with a cooling water supply conduit or an outdoor air supply conduit for supplying cooling water or cold outdoor air for condensation, structure of the condensing drying apparatus becomes complicated.

In order to solve the above problems of the conventional drying apparatus using the heat pump and the conventional condensing drying apparatus, the development of new condensation type drying apparatus is needed.

SUMMARY OF THE INVENTION

Accordingly, the present invention is directed to a drying apparatus that substantially obviates one or more problems due to limitations and disadvantages of the related art.

An object of the present invention is to provide a drying apparatus of a new environmentally friendly condensation type which can increase drying efficiency and energy efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a thermoelectric module comprising: a heat absorption side and a heat dissipation side which absorbs and dissipates heat at a junction between two dissimilar metals depending on direction of current flow through the junction. The heat absorption side is disposed at a hot air flowing passage.

In another aspect of the present invention, there is provided a drum washing machine comprising: a tub which stores water; a drum which is rotatably mounted in the tub; a motor which transfers a driving force to the drum; a circulation duct which forms an air circulation passage so that air exhausted from the drum flows again into the drum; and a thermoelectric module described above which condenses water contained in the air exhausted from the drum to remove the water from the air.

Preferably, the thermoelectric module is mounted so that the air exhausted from the drum passes by a heat absorption side of the thermoelectric module.

Preferably, the drum washing machine further comprises a cooling fan for air-cooling a heat dissipation side of the thermoelectric module.

Preferably, the drum washing machine further comprises a water-supply duct for water-cooling a heat dissipation side of the thermoelectric module.

Preferably, the drum washing machine further comprises an outdoor air-supply duct for air-cooling a heat dissipation side of the thermoelectric module and guiding outdoor air into the drum.

Preferably, the drum washing machine further comprises a heat sink which is mounted to a heat dissipation side of the thermoelectric module.

In yet another aspect of the present invention, there is provided a clothes dryer comprising: a drum into which objects to be dried are put; a circulation duct which forms an air circulation passage so that air exhausted from the drum flows again into the drum; a condenser of a thermoelectric module type described above which condenses the air exhausted from the drum; a heater which heats the air; and a circulation fan which forcedly circulates the air through the circulation duct.

Preferably, the condenser of the thermoelectric module type is mounted so that the air exhausted from the drum passes by a heat absorption side of the thermoelectric module.

Preferably, the air passing by the heat absorption side flows into the drum via a heat dissipation side of the thermoelectric module.

Preferably, the condenser of the thermoelectric module type includes thermoelectric modules which are arranged in a multi-layer structure with a gap therebetween, and the thermoelectric modules respectively include at least one pair of heat absorption sides which oppose each other.

Preferably, the air passing by a space between the heat absorption sides flows into the drum via heat dissipation sides of the thermoelectric modules.

Preferably, the clothes dryer further comprises an outdoor air-supply duct which is connected to the condenser of the thermoelectric module type to supply outdoor air so that the outdoor air passes by the heat dissipation sides of the condenser of the thermoelectric module type; an outdoor air-discharge duct which is connected to the condenser of the thermoelectric module type to discharge the outdoor air passing by the heat dissipation sides of the condenser of the thermoelectric module type; a cooling fan which is mounted on the outdoor air-supply duct or the outdoor air-discharge duct to suck and discharge the outdoor air; and a variable speed motor which drives the cooling fan.

Preferably, the clothes dryer further comprises a guide duct which is connected to the outdoor-discharge duct to bypass a portion of the outdoor air discharged through the outdoor-discharge duct toward the heater.

preferably, the heater is capable of changing a heat release rate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A thermoelectric module comprises a thermoelectric device which absorbs or dissipates heat at a junction between two dissimilar metals depending on direction of current flow through the junction.

The thermoelectric device of the thermoelectric module 10 will be described with reference to FIG. 1.

The thermoelectric module 10 of the present invention is modularized by parallely connecting the thermoelectric devices in which temperature difference is generated on both sides by a difference of an electromotive force, and causes the Peltier effect.

Figure 1:
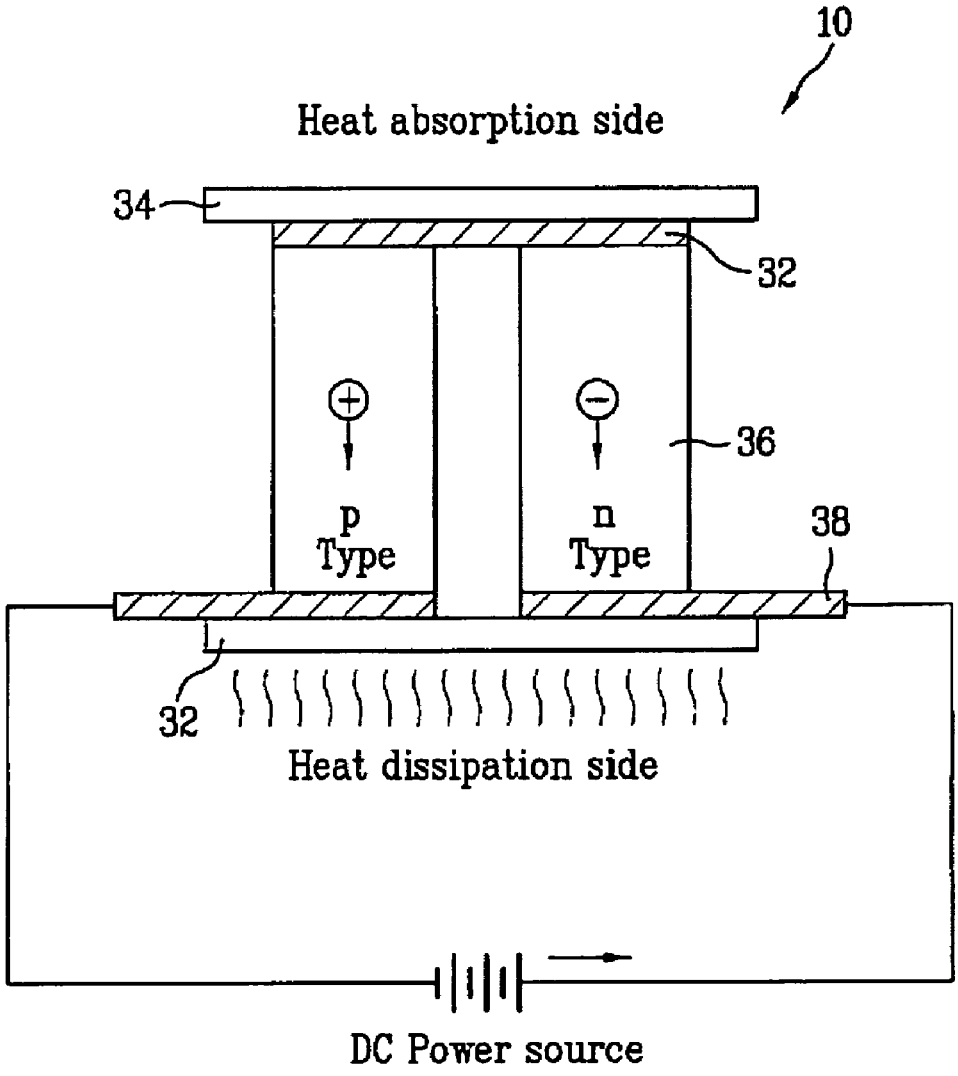
FIG. 1 is a constitutional view showing a thermoelectric module in accordance with the present invention.

FIG. 1 is a sectional view schematically illustrating a structure of the thermoelectric device of the thermoelectric module according to the present invention. As shown in the drawing, thermoelectric elements 33 which consist of an N-type semiconductor or a P-type semiconductor are arranged in parallel. Electrodes 31 and 34 like a copper plate are attached to tops and bottoms of the thermoelectric elements 33, respectively. And, ceramic substrates 32 are attached to the electrodes 31 and 34 to cover the same.

If applying direct current to the junction of the thermoelectric device, the Peltier effect arises such that electrons in the N-type semiconductor and holes in the P-type semiconductor move from the upper electrode to the lower electrode to absorb heat from the upper side and dissipate heat to the lower side. Accordingly, the upper heat absorption side is cooled, and the lower heat dissipation side is heated.

In other words, the Peltier effect is a phenomenon in which heat is dissipated or absorbed at the junction of two dissimilar metals, depending upon the direction of the current flow through the junction.

Accordingly, when current is applied to the thermoelectric device, one side of the thermoelectric device becomes the heat absorption side of low temperature, and the other side becomes the heat dissipation side of high temperature. If applying the current to the thermoelectric device in a reverse direction, the heat absorption side and the heat dissipation side are changed into each other.

The thermoelectric module 10 has features that cooling speed is high, temperature is accurately adjusted, partial cooling and operation in all directions are achieved, and the heat absorption side and the heat dissipation side are easily changed into each other only by changing the direction of the current flow. Therefore, the thermoelectric module 10 can be variously designed corresponding to desired conditions.

Also, the thermoelectric module 10 has no mechanical operation sound and vibration, does not use refrigerant (is environmentally friendly), and can be manufactured compactly.

The shape of the thermoelectric module 10 can be diversely varied according to using purpose, from the general shape of a rectangular plate to a curved plate, etc. The exemplary embodiments of installing the thermoelectric module 10 will now be described in detail.

Figure 2:
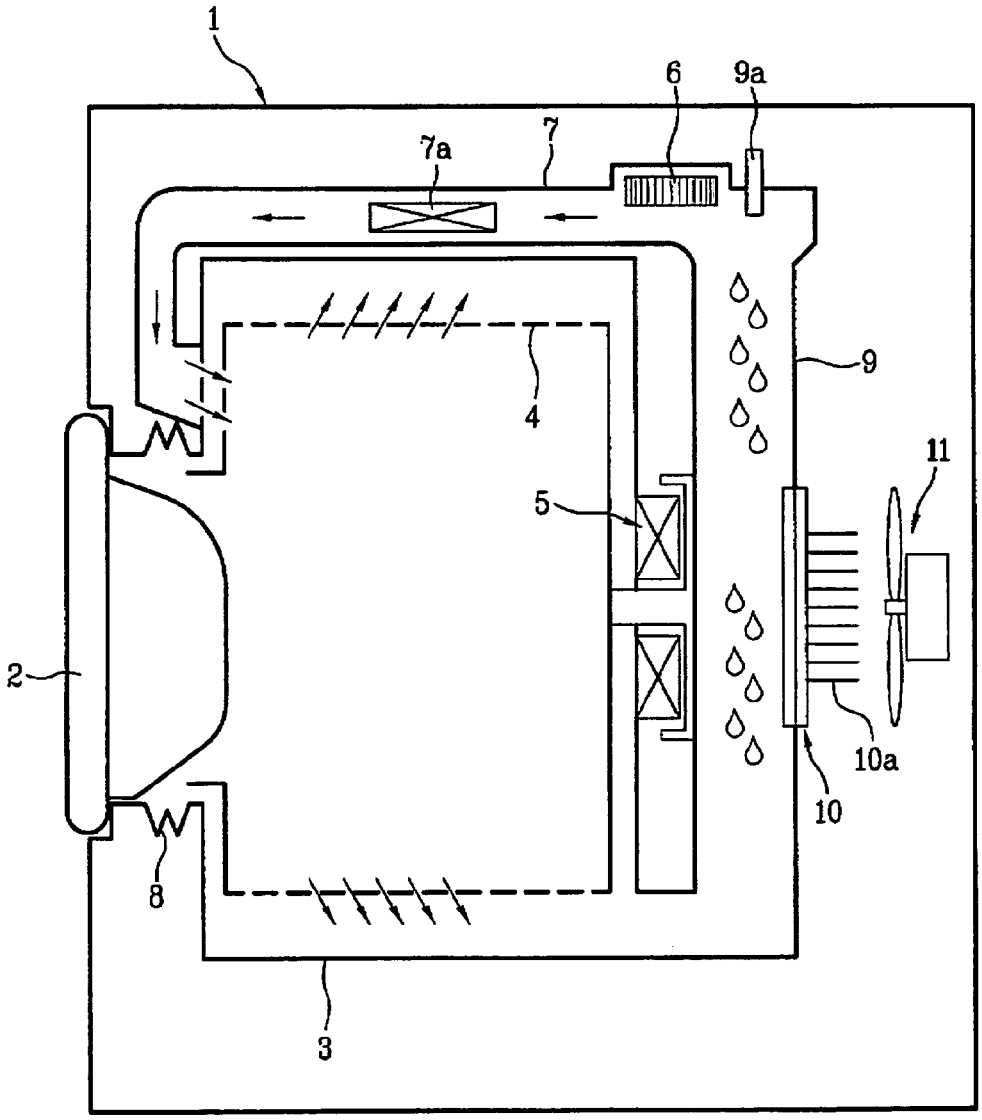
FIG. 2 is a constitutional view showing a first embodiment of a drying apparatus equipped with a thermoelectric module in accordance with the present invention.

FIG. 2 is a constitutional view showing a drying apparatus in accordance with a first embodiment of the present invention. A drying apparatus depicted in FIG. 2 is a washing machine, which comprises a cabinet 1 for forming an outer appearance, and a tub 3 which is mounted inside the cabinet 1 for storing water. Inside the tub 3, a drum 4 is rotatably mounted and a motor 5 for transferring a driving force to the drum 4 is mounted. A circulation duct is provided to form an air circulation passage, through which air exhausted from the drum 4 flows again into the drum 4.

The thermoelectric module 10 is mounted to a side of the circulation duct to remove water from wet air exhausted from the drum 4 by condensing the same. It is preferable to mount the thermoelectric module 10 so that the wet air exhausted from the drum 4 passes by the heat absorption side of the thermoelectric module 10.

A condensation duct 9 is connectingly provided between a wet air outlet of the drum 4 and a drying duct 7. The thermoelectric module 10 is mounted to a side of the condensation duct 9 such that the heat absorption side of the thermoelectric module 10 faces the passage formed in the condensation duct 9.

The heat dissipation side of the thermoelectric module 10 is exposed outside from the condensation duct 9. It is preferable to mount a heat sink 10*a* for promoting the heat radiation to the heat dissipation side of the thermoelectric module 10.

In other words, one side of the thermoelectric module 10 is disposed toward the wet air flowing passage to perform the condensation, and the other side is disposed toward the cold outdoor air flowing passage to perform the heat radiation.

The circulation duct includes the drying duct 7 for supplying hot air into the drum 4, and the condensation duct 9 for connecting the wet air outlet of the drum 4 to the drying duct 7.

A fan 6 for circulating the air and a heater 7*a* for heating the air passing through the condensation duct 9 to a temperature adequate for drying the laundry are mounted inside the drying duct 7.

A cooling fan 11 for air-cooling the heat dissipation side of the thermoelectric module 10 is provided while opposing the heat dissipation side.

The cooling fan 11 may be mounted inside the cabinet 1, or mounted to the tub 3 by fixing means.

Drying process of the drying apparatus according to a first embodiment of the present invention will now be described.

If the drying process is started, power is applied to the heater 7*a* mounted in the drying duct 7.

The heater 7*a* operates to heat the circulation air, and the fan 6 operates to blow the hot air.

The hot air is blown into the drum 4 via the tub 3 by being guided by the drying duct 7.

The hot air entering the drum 4 heats the laundry to evaporate the water contained in the laundry. At this time, the laundry is repeatedly turned over while the drum 4 rotates at a low speed, so that the laundry is evenly exposed to the hot air to promote the evaporation of the water.

The circulation air containing the evaporated water is exhausted from the drum 4, and flows along the condensation duct 9 by the operation of the fan 6.

The thermoelectric module 10 mounted to the condensation duct 9 condenses the water contained in the circulation air to remove the water from the circulation air.

In other words, the circulation air flowing along the condensation duct 9 becomes dry air by removing the water by heat exchange with the heat absorption side of the thermoelectric module 10.

The water-removed circulation air flows into the drying duct 7 by the operation of the fan 6, and the air is heated by the heater 7*a* in the drying duct 7. Then, the hot air reenters the drum 4 and performs a function of drying the laundry.

By the above-described drying cycle being repeated, the drying of the laundry is achieved.

On the other hand, while the water is removed from the wet air through the condensation by the thermoelectric module 10, heat is generated from the heat dissipation side of the thermoelectric module 10. The cooling fan 11 is driven to cool the heat dissipation side of the thermoelectric module 10.

A motor for driving the cooling fan 11 may be a variable speed motor (e.g., a brushless DC motor), which drives only the cooling fan 11 apart from the motor 5 for rotating the drum 4.

A drain hose (not shown) is connected to the condensation duct 9. When a drain valve (not shown) mounted on the drain hose is opened, the condensed water gathering in the condensation duct 9 by the repeated condensation of the circulation air is discharged through the drain hose.

Accordingly, the drum washing machine equipped with the drying apparatus according to the first embodiment of the present invention has features that temperature is accurately controlled, drying efficiency and performance are increased, and drying time is shortened by using the thermoelectric module 10 which can further lower temperature of the heat absorption side for condensation of the wet air in comparison with the conventional condensation method by the cooling water.

As described above, to dispose the heat absorption side of the thermoelectric module 10 inside the condensation duct 9 is effective in condensing the water contained in the wet air, however, this is not limited thereto. The installing structure of the thermoelectric module 10 may be modified such that the heat absorption side of the thermoelectric module 10 is contactingly mounted to an outer surface of the condensation duct 9 and at least a portion of the condensation duct 9 in contact with the heat absorption side is made of material having high thermal conductivity. Such a modification of the installing structure of the thermoelectric module 10 is also applied to other embodiments of the present invention which will be described later.

Figure 3:
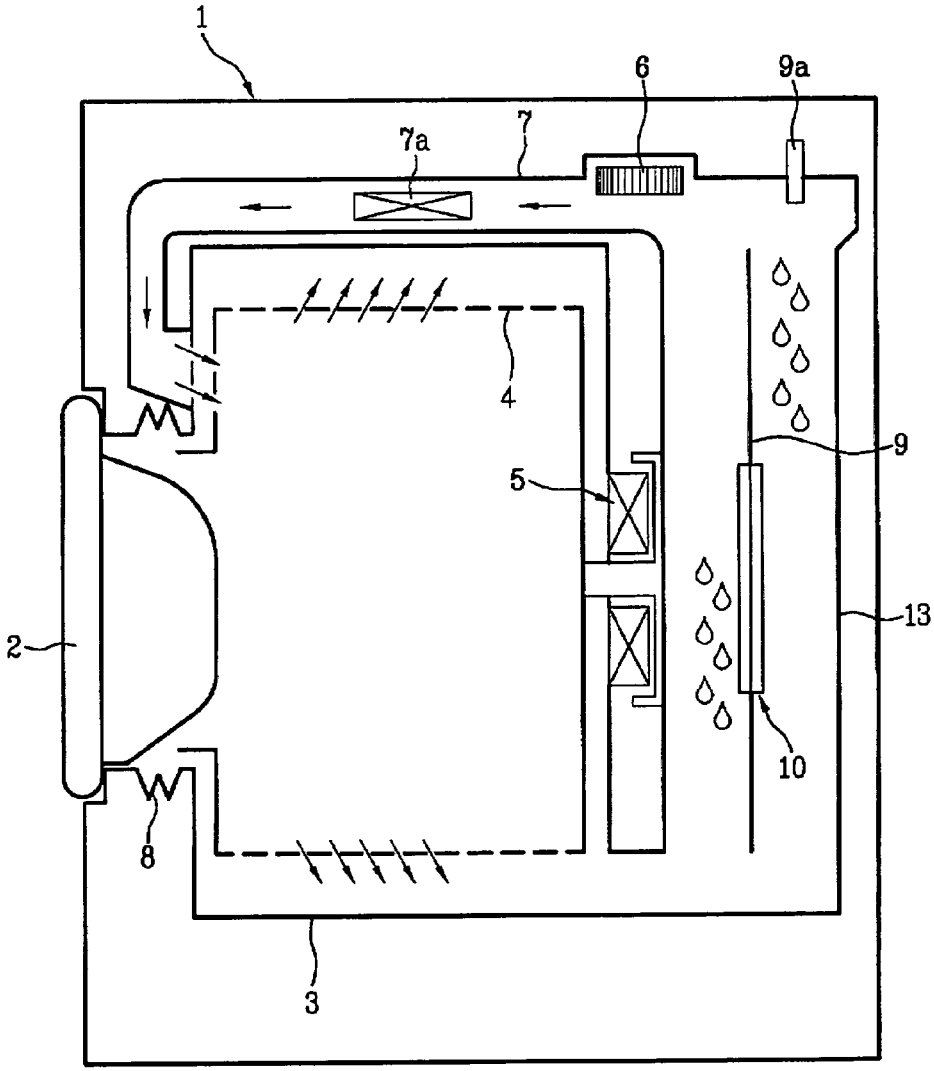
FIG. 3 is a constitutional view showing a second embodiment of a drying apparatus equipped with a thermoelectric module in accordance with the present invention.

Hereinafter, a drying apparatus according to a second embodiment of the present invention will be described with reference to FIG. 3.

A drying apparatus (a drum washing machine) according to the second embodiment of the present invention comprises a cabinet 1 for forming an outer appearance, a tub 3 which is mounted inside the cabinet 1 for storing water, a drum 4 which is rotatably mounted inside the tub 3, a motor 5 for transferring a driving force to the drum 4, a circulation duct for forming an air circulation passage through which air exhausted from the drum 4 flows again into the drum 4, and a thermoelectric module 10 for removing water from wet air exhausted from the drum 4 by condensing the same.

Similarly to the first embodiment, the thermoelectric module 10 comprises a thermoelectric device which absorbs or dissipates heat at a junction between two dissimilar metals depending on direction of current flow through the junction. It is preferable to mount the thermoelectric module 10 so that the wet air exhausted from the drum 4 passes by the heat absorption side of the thermoelectric module 10.

A condensation duct 9 is connectingly provided between a wet air outlet of the drum 4 and a drying duct 7. The thermoelectric module 10 is mounted to a side of the condensation duct 9 such that the heat absorption side is disposed inside the condensation duct 9 and the heat dissipation side is disposed outside the condensation duct 9.

A water-supply duct 13 is mounted outside the condensation duct 9 so that the heat dissipation side of the thermoelectric module 10 is positioned inside the water-supply duct 13. Cooling water is guided by the water-supply duct 13 to be directed toward the thermoelectric module 10. A water-supply device 9*a* is mounted to the water-supply duct 13 above the thermoelectric module 10. The water-supply device 9*a* supplies the cooling water toward the heat dissipation side of the thermoelectric module 10 to cool down the same.

The circulation duct includes the drying duct 7 for supplying hot air into the drum 4, and the condensation duct 9 for connecting the wet air outlet of the drum 4 to the drying duct 7.

A fan 6 for circulating the air and a heater 7*a* for heating the air passing through the condensation duct 9 to a temperature adequate for drying the laundry are mounted inside the drying duct 7.

A heat sink (not shown) may be mounted to the heat dissipation side of the thermoelectric module 10 to promote the heat radiation.

Drying process of the drying apparatus according to the second embodiment of the present invention will now be described.

If the drying process is started, power is applied to the heater 7*a* mounted in the drying duct 7. The heater 7*a* operates to heat the circulation air, and the fan 6 operates to blow the hot air.

The hot air is blown into the drum 4 via the tub 3 by being guided by the drying duct 7.

The hot air entering the drum 4 heats the laundry to evaporate the water contained in the laundry. At this time, the laundry is repeatedly turned over while the drum 4 rotates at a low speed, so that the laundry is evenly exposed to the hot air to promote the evaporation of the water.

The circulation air containing the evaporated water is exhausted from the drum 4, and flows along the condensation duct 9 by the operation of the fan 6.

The thermoelectric module 10 mounted to the condensation duct 9 condenses the water contained in the circulation air to remove the water from the circulation air.

In other words, the circulation air flowing along the condensation duct 9 becomes dry air by removing the water by heat exchange with the heat absorption side of the thermoelectric module 10.

The water-removed circulation air flows into the drying duct 7 by the operation of the fan 6, and the air is heated by the heater 7*a* in the drying duct 7. Then, the hot air reenters the drum 4 and performs a function of drying the laundry.

On the other hand, the cooling water is supplied toward the heat dissipation side of the thermoelectric module 10 from the water-supply device 9*a* by being guided by the water-supply duct 13, to cool down the heat dissipation side.

By the above-described drying cycle being repeated, the drying of the laundry is achieved.

A drain hose (not shown) is connected to the condensation duct 9. When a drain valve (not shown) mounted on the drain hose is opened, the condensed water gathering in the condensation duct 9 by the repeated condensation of the circulation air is discharged through the drain hose.

Accordingly, identically to the first embodiment, the drum washing machine equipped with the drying apparatus according to the second embodiment of the present invention has features that temperature is accurately controlled, drying efficiency and performance are increased, and drying time is shortened by using the thermoelectric module 10 which can further lower temperature of the heat absorption side for condensation of the wet air in comparison with the conventional condensation method by the cooling water.

Figure 4:
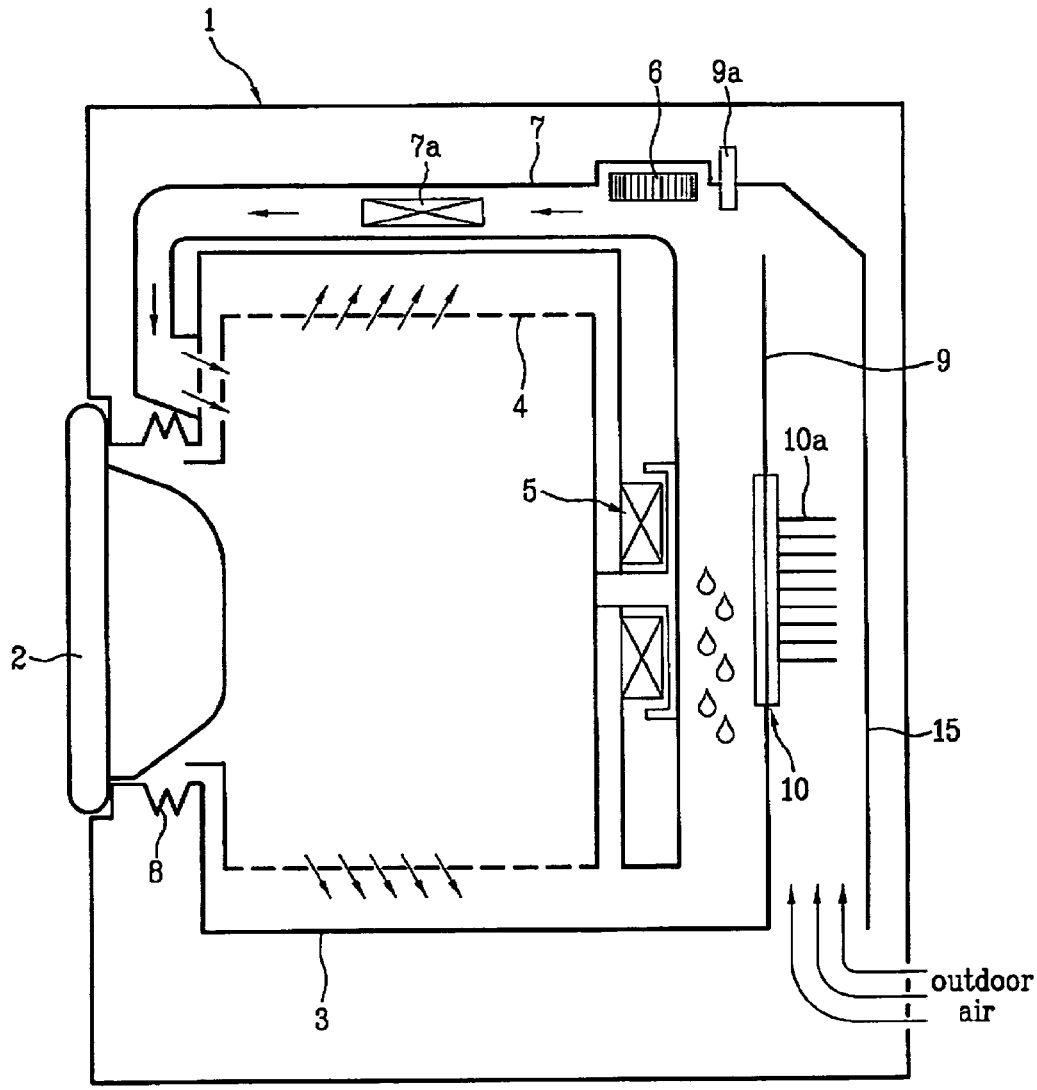
FIG. 4 is a constitutional view showing a third embodiment of a drying apparatus equipped with a thermoelectric module in accordance with the present invention.

Hereinafter, a drying apparatus according to a third embodiment of the present invention will be described with reference to FIG. 4.

A drying apparatus (a drum washing machine) according to the third embodiment of the present invention comprises a cabinet 1 for forming an outer appearance, a tub 3 which is mounted inside the cabinet 1 for storing water, a drum 4 which is rotatably mounted inside the tub 3, a motor 5 for transferring a driving force to the drum 4, a circulation duct for forming an air circulation passage through which air exhausted from the drum 4 flows again into the drum 4, and a thermoelectric module 10 for removing water from wet air exhausted from the drum 4 by condensing the same.

Similarly to the first and second embodiments, the thermoelectric module 10 comprises a thermoelectric device which absorbs or dissipates heat at a junction between two dissimilar metals depending on direction of current flow through the junction. It is preferable to mount the thermoelectric module 10 so that the wet air exhausted from the drum 4 passes by the heat absorption side of the thermoelectric module 10.

More particularly, a condensation duct 9 is connectingly provided between a wet air outlet of the drum 4 and a drying duct 7. The thermoelectric module 10 is mounted to a side of the condensation duct 9 such that the heat absorption side is disposed inside the condensation duct 9.

And, the heat dissipation side of the thermoelectric module 10 is exposed outside of the condensation duct 9.

In other words, one side of the thermoelectric module 10 is disposed toward the wet air flowing passage to perform the condensation, and the other side is disposed toward the cold outdoor air flowing passage to perform the heat radiation.

An outdoor air-supply duct 15 is mounted outside the condensation duct 9 so that the heat dissipation side of the thermoelectric module 10 is positioned inside the outdoor air-supply duct 15. The outdoor air having a lower temperature than the heat dissipation side of the thermoelectric module 10 is guided by the outdoor air-supply duct 15 to be directed toward the heat dissipation side. The outdoor air-supply duct 15 communicates with the condensation duct 9 at a point above the thermoelectric module 10, so that the outdoor air can join the circulation air after the condensation.

For this, it is preferable that an outdoor air inlet is formed at a lower end portion of the outdoor air-supply duct 15 and a communication point with the condensation duct 9 is formed at an upper end portion of the outdoor air-supply duct 15.

The circulation duct includes the drying duct 7 for supplying hot air into the drum 4, and the condensation duct 9 for connecting the wet air outlet of the drum 4 to the drying duct 7.

A fan 6 for circulating the air and a heater 7*a* for heating the air passing through the condensation duct 9 to a temperature adequate for drying the laundry are mounted inside the drying duct 7.

A heat sink 10*a* is mounted to the heat dissipation side of the thermoelectric module 10 to promote the heat radiation.

Drying process of the drying apparatus according to the third embodiment of the present invention will now be described.

If the drying process is started, power is applied to the heater 7*a* mounted in the drying duct 7. The heater 7*a* operates to heat the circulation air, and the fan 6 operates to blow the hot air.

The hot air is blown into the drum 4 via the tub 3 by being guided by the drying duct 7.

The hot air entering the drum 4 heats the laundry to evaporate the water contained in the laundry. At this time, the laundry is repeatedly turned over while the drum 4 rotates at a low speed, so that the laundry is evenly exposed to the hot air to promote the evaporation of the water.

The circulation air containing the evaporated water is exhausted to the condensation duct 9 through the wet air outlet of the drum 4, and flows along the condensation duct 9 by the operation of the fan 6.

The thermoelectric module 10 mounted to the condensation duct 9 condenses the water contained in the circulation air to remove the water from the circulation air.

In other words, the circulation air flowing along the condensation duct 9 becomes dry air by removing the water by heat exchange with the heat absorption side of the thermoelectric module 10.

The water-removed circulation air flows into the drying duct 7 by the operation of the fan 6, and the air is heated by the heater 7*a* in the drying duct 7. Then, the hot air reenters the drum 4 and performs a function of drying the laundry.

On the other hand, the outdoor air is supplied toward the heat dissipation side of the thermoelectric module 10 by being guided by the outdoor air-supply duct 15, to cool down the heat dissipation side.

By the above-described drying cycle being repeated, the drying of the laundry is achieved.

A drain hose (not shown) is connected to the condensation duct 9. When a drain valve (not shown) mounted on the drain hose is opened, the condensed water gathering in the condensation duct 9 by the repeated condensation of the circulation air is discharged through the drain hose.

Accordingly, identically to the first and second embodiments, the drum washing machine equipped with the drying apparatus according to the third embodiment of the present invention has features that temperature is accurately controlled, drying efficiency and performance are increased, and drying time is shortened by using the thermoelectric module 10 which can further lower temperature of the heat absorption side for condensation of the wet air in comparison with the conventional condensation method by the cooling water.

Especially, the third embodiment of the present invention further has features that a desired capacity of the heater 7*a* can be decreased by reducing load applied to the heater 7*a* because the outdoor air having much lower relative humidity than the circulation air is warmed to a certain extent by heat exchange with the heat dissipation side of the thermoelectric module 10 and then enters the drum 4.

Figure 5:
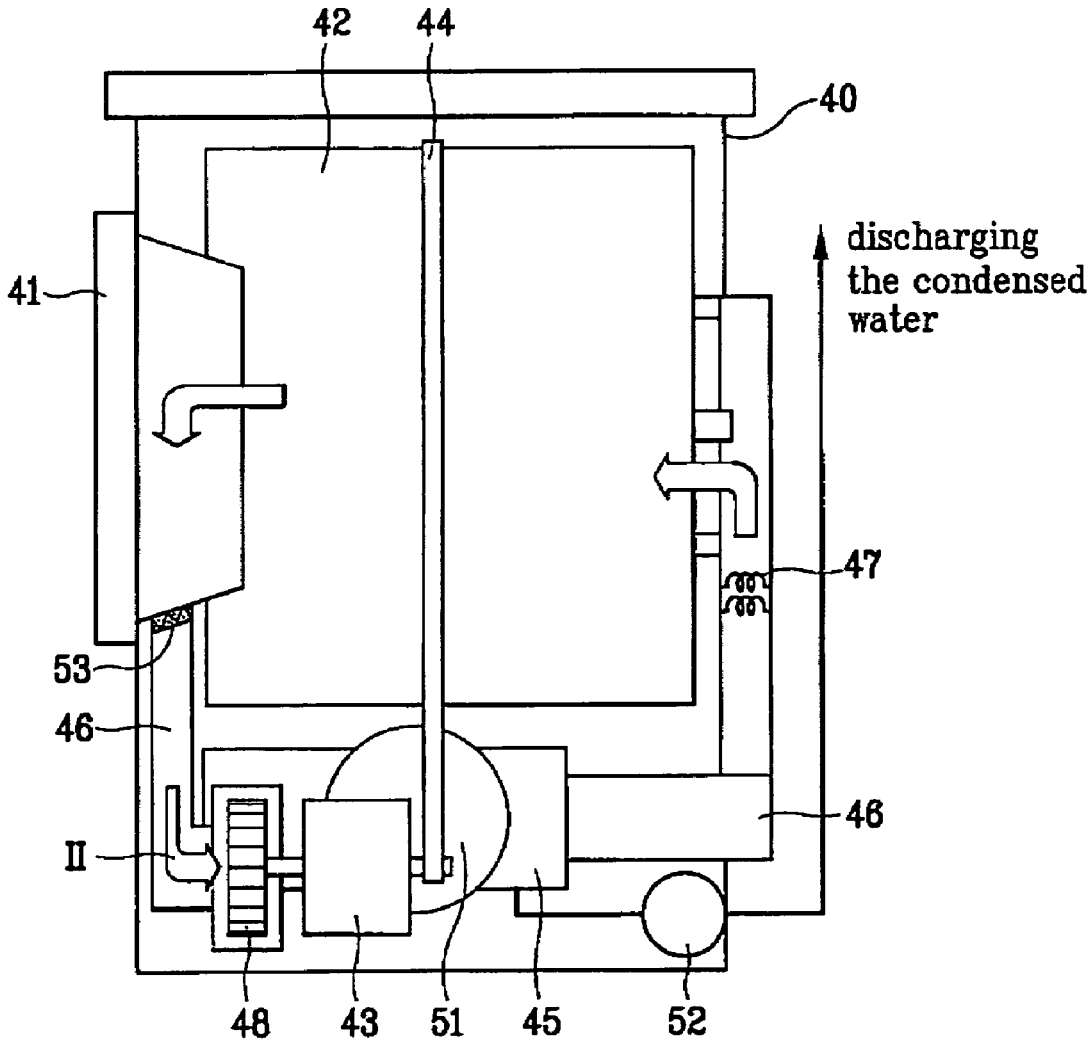
FIG. 5 is a constitutional view showing a fourth embodiment of a drying apparatus equipped with a thermoelectric module in accordance with the present invention.
Figure 6:
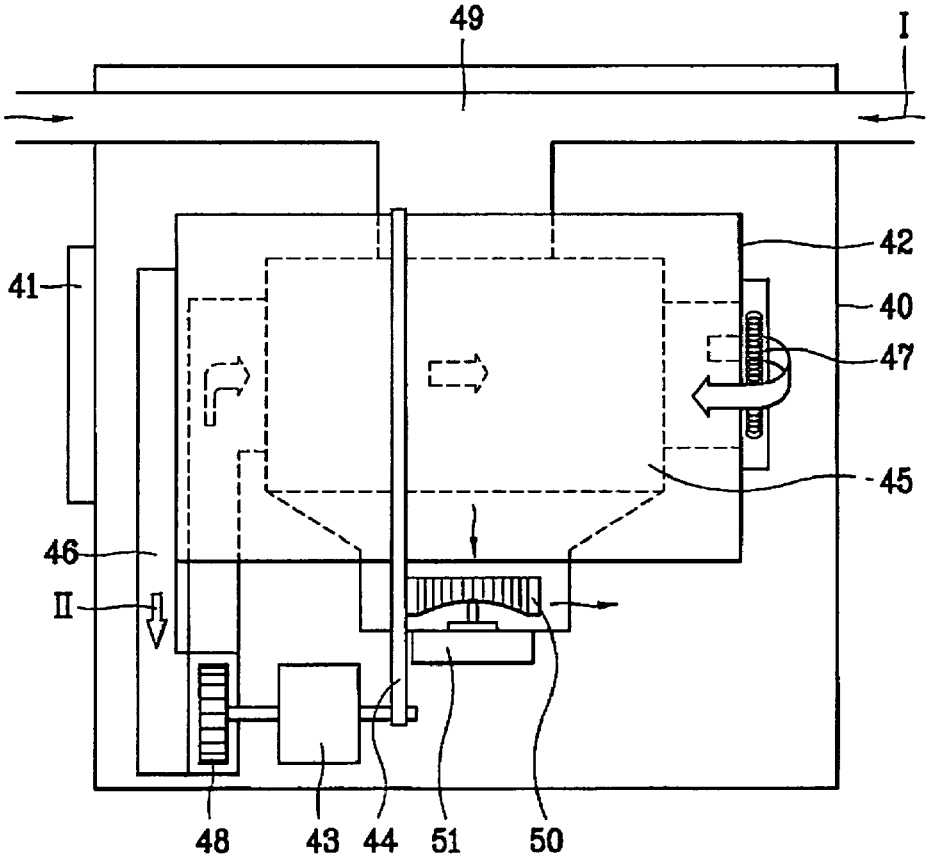
FIG. 6 is a plan view showing a drying apparatus depicted in FIG. 5.

As shown in FIG. 5, a drying apparatus according to a fourth embodiment of the present invention is a condensing clothes dryer. The condensing clothes dryer comprises a main body 40 which is provided with a door 41 at its front portion, and a drum 42 which is rotatably mounted inside the main body 40 to store objects to be dried (e.g., wet clothes). The drum 42 is connected to a motor 43 by a belt 44. The motor 43 is mounted to a lower portion in the main body 40, and a driving force from the motor 43 is transferred to the drum 42 to rotate the same via the belt 44.

A thermoelectric module type condenser 45 is mounted to the lower portion in the main body 40 to transform air of high temperature and humidity circulating through the drum 42 into dry air by condensing the same.

Figure 9:
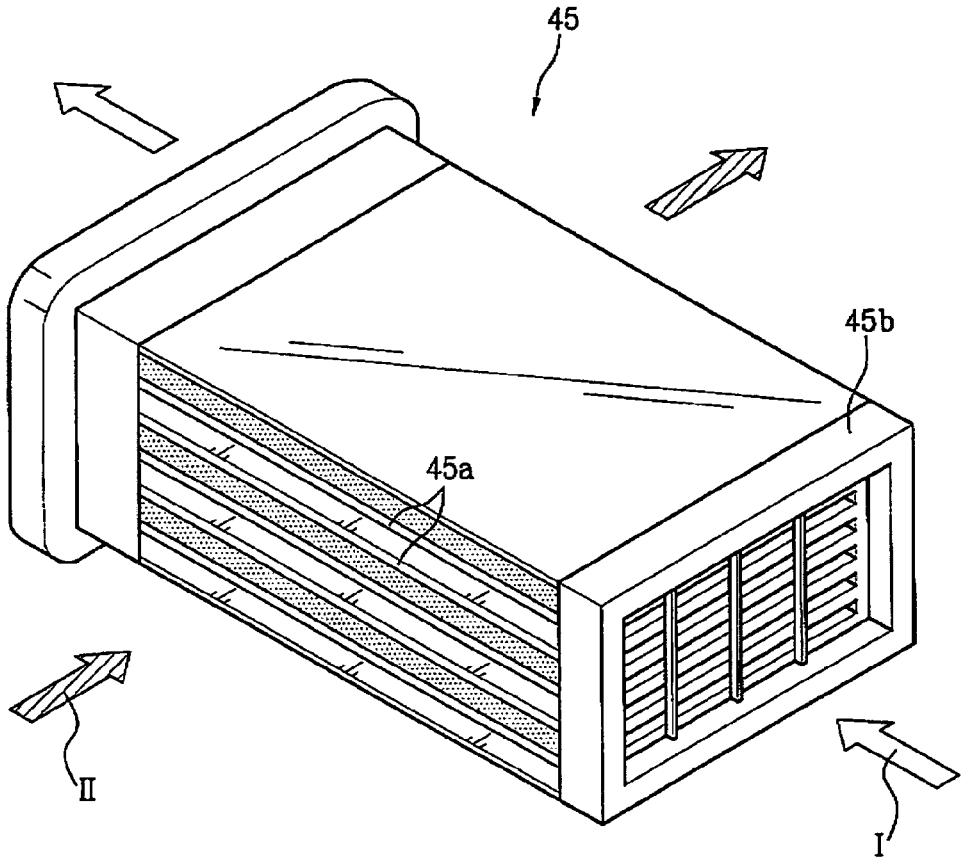
FIG. 9 is a perspective view showing a structure of a condenser of a thermoelectric module used in fourth, fifth and sixth embodiments in accordance with the present invention.

As shown in FIG. 9, the thermoelectric module type condenser 45 includes a rectangular parallelepiped-shaped frame 45*b* and multi-layered thermoelectric module type condenser plates 45*a* which are arranged with a regular gap therebetween inside the frame 45*b*. The respective thermoelectric module type condenser plates 45*a* have a heat absorption side and a heat dissipation side. The circulation air to be condensed passes by the heat absorption sides of the thermoelectric module type condenser plates 45*a* in a front and rear direction of the condenser, and the cold outdoor air passes by the heat dissipation sides of the thermoelectric module type condenser plates 45*a* in a left and right direction of the condenser to cool down the heat dissipation side. That is, a passage for the circulation air and a passage for the outdoor air are separately formed in the thermoelectric module type condenser 45.

A heat sink (not shown) may be mounted to the heat dissipation sides of the thermoelectric module type condenser plates 45*a*.

A circulation duct 46 is connected to a front side and a rear side of the drum 42. The thermoelectric module type condenser 45 is communicatingly mounted on the circulation duct 46 so that the air exhausted from the drum 42 passes through the thermoelectric module type condenser 45 in the front and rear direction of the condenser and reenters the drum 42.

A heater 47 for heating the air passing through the thermoelectric module type condenser 45 and a circulation fan 48 for forcedly circulating the air through the circulation duct 46 are mounted on the circulation duct 46. The circulation fan 48 is connected to another driving shaft of the motor 43 for driving the drum 42.

When the air circulating through the circulation duct 46 is condensed by heat exchange with the heat absorption side in the thermoelectric module type condenser 45, the heat dissipation sides of the thermoelectric module type condenser 45 should be cooled down, e.g., by supplying the cold outdoor air into the thermoelectric module type condenser 45. For this, an outdoor air-supply duct 49 communicating with the outside of the main body 40 is connected to a portion of the thermoelectric module type condenser 45. And, a cooling fan 50 for sucking the outdoor air through the outdoor air-supply duct 49 and supplying the outdoor air into the main body 40 and a cooling fan driving motor 51 are mounted to a portion of the thermoelectric module type condenser 45, opposite to the outdoor air-supply duct 49.

The cooling fan driving motor 51 may be a variable speed motor (e.g., a brushless DC motor), which drives only the cooling fan 51 apart from the motor 43 for rotating the circulation fan 48 and the drum 42.

Under the thermoelectric module type condenser 45 are mounted a water-receiving member (not shown) for gathering the dropped condensed water and a pump 52 for forcedly discharging the condensed water from the water-receiving member or transferring the condensed water to a water bucket (not shown) mounted in the main body 40.

A non-described reference numeral 53 is a lint filter for filtering a substance like waste thread or fluff from the air exhausted into the circulation duct 46 from the front side of the drum 42.

Control process of the clothes dryer according to the fourth embodiment of the present invention will now be described.

After putting the objects to be dried (e.g., the wet clothes) into the drum 42, if starting the operation by selecting a drying mode, the motor 43 and the heater 47 are driven to rotate the circulation fan 48 and the drum 42. At this time, the cooling fan driving motor 51 does not operate.

The air flows through the circulation duct 46, and is heated to high temperature by the heater 47. The heated air flows into the drum 42.

If a preset time X elapses or the temperature of the circulation air in the drum 42 and the circulation duct 46 rises to a target value T, the thermoelectric module type condenser 45 and the cooling fan driving motor 51 are turned on.

The air of high temperature and humidity after drying the wet objects in the drum 42 passes by the heat absorption sides of the thermoelectric module type condenser 45 and is dried by being condensed by heat exchange with the heat absorption sides. Then, the dried air is heated by the heater 47 and enters the drum 42.

The cooling fan driving motor 51 is driven to rotate the cooling fan 50. By the operation of the cooling fan 50, the outdoor air passes by the heat dissipation sides of the thermoelectric module type condenser 45 through the outdoor air-supply duct 49 and cools down the heat dissipation sides by heat exchange therewith. Then, the air is discharged from the main body 40.

In this embodiment, a point of time when driving the cooling fan driving motor 51 to rotate the cooling fan 50 may be controlled by the preset time X stored in a controller based upon experiments of measuring time until the temperature of the circulation air flowing in the drum 42 rises to the target value T or by disposing a temperature sensor (not shown) in the drum 42 or the circulation duct 46 to detect whether the temperature of the circulation air rises to the target value T.

On the other hand, when the heater 47 capable of changing a heat release rate is used, a speed of the cooling fan driving motor 51 is changed according to the heat release rate of the heater 47, so as to perform the drying operation with an optimal flow rate.

For example, when the heat release rate of the heater 47 is over a predetermined value $Q_2$, the cooling fan driving motor 51 is driven at the high speed to increase flow rate for promoting the drying operation. When the heat release rate of the heater 47 is under the predetermined value $Q_1$, the cooling fan driving motor 51 is driven at the low speed to reduce operational noise.

In the above description, it has been explained that the cooling fan driving motor 51 does not operate at the initial operation until the temperature of the circulation air rises to the predetermined target value, however, this is not restricted thereto. At the initial operation of the clothes dryer, the cooling fan driving motor 51 may be operated simultaneously with the operation of the motor 43. At this time, the cooling fan driving motor 51 is driven at the low speed to slow down the rotation of the cooling fan 50. And, if the preset time X elapses or the temperature of the circulation air in the drum 42 and the circulation duct 46 rises over the target value T, the cooling fan 50 is rotated at the normal speed so as to perform the drying operation.

Identically to the previous embodiment, in this case, the speed of the cooling fan driving motor 51 can also be changed according to the heat release rate of the heater 47 so as to perform the optimal drying operation. So, the detailed description thereof will be omitted.

The thermoelectric device of the thermoelectric module type condenser used in the previous embodiments and the following embodiments is same as the thermoelectric device depicted in FIG. 1.

The thermoelectric module type condenser plate 45*a*, is formed in a plate shape, more particularly, a rectangular plate shape.

Figure 7:
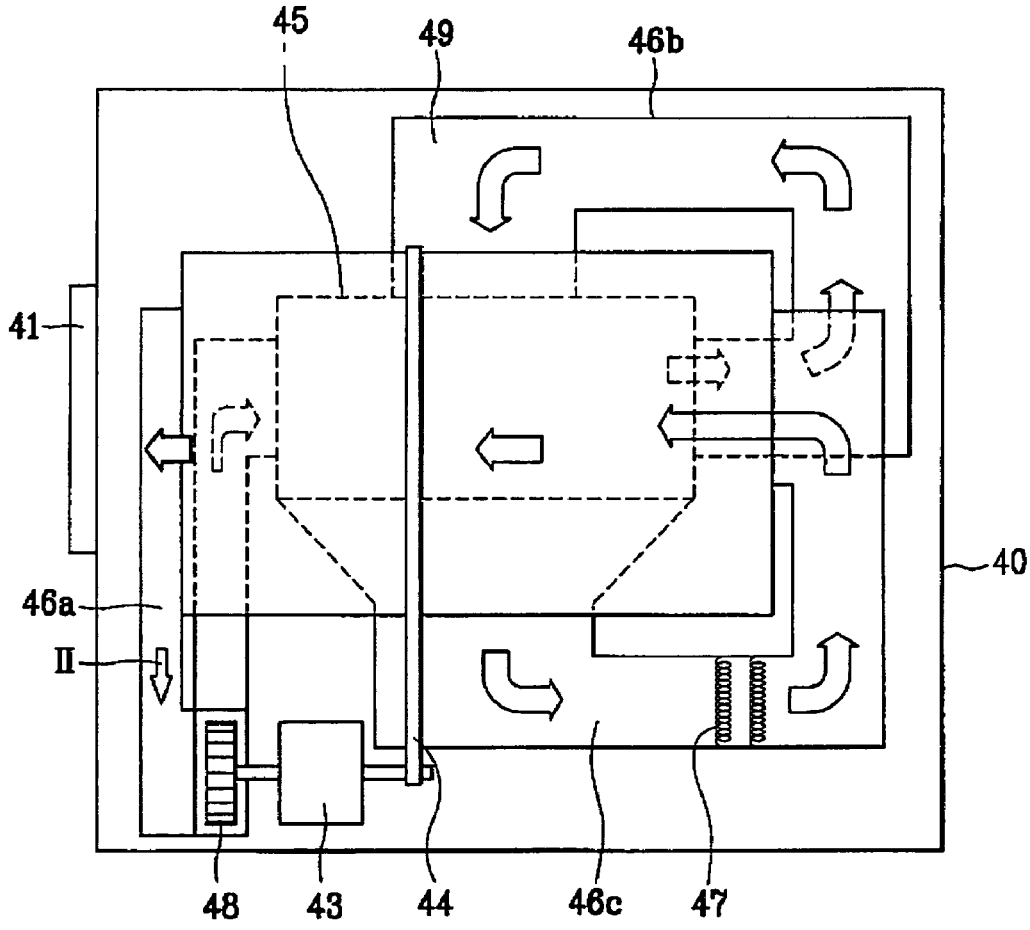
FIG. 7 is a constitutional view showing a fifth embodiment of a drying apparatus equipped with a thermoelectric module in accordance with the present invention.

Hereinafter, a condensing clothes dryer according to a fifth embodiment of the present invention will be described with reference to FIGS. 7 and 9.

A condensing clothes dryer according to the fifth embodiment of the present invention has features of having a pure circulation type operation in which outdoor air supplying means for cooling down the heat dissipation side of the thermoelectric module type condenser 45 is unnecessary.

A circulation air passage structure of the clothes dryer of this embodiment will be described with reference to FIG. 7.

The condensing clothes dryer of this embodiment comprises a drum 42 into which the objects to be dried (e.g., the wet clothes) are put, a thermoelectric module type condenser 45 for condensing the air exhausted from the drum 42, a circulation duct 46 for forming an air circulation passage by which the air exhausted from the drum 42 passes through the thermoelectric module type condenser 45 and reenters the drum 42, a heater 47 for heating the circulation air, and a circulation fan 48 which is connected to a motor 43 and forcedly circulates the air through the circulation duct 46.

The thermoelectric module type condenser 45 has a structure of stacking thermoelectric module type condenser plates 45*a* constituted by a thermoelectric device (see FIG. 1) which absorbs or dissipates heat at a junction between two dissimilar metals depending on direction of current flow through the junction. The air exhausted from the drum 42 passes by heat absorption sides and heat dissipation sides of the thermoelectric module type condenser plates 45*a* in order.

In other words, as shown in FIG. 9, the thermoelectric module type condenser 45 includes the rectangular parallelepiped-shaped frame 45*b* and the multi-layered thermoelectric module type condenser plates 45*a* which are arranged with a regular gap therebetween inside the frame 45*b*. The respective thermoelectric module type condenser plates 45*a* have the heat absorption side and the heat dissipation side. The circulation air passes by the heat absorption sides of the thermoelectric module type condenser plates 45*a* in a front and rear direction of the condenser. And, the circulation air from which the water is removed while passing by the heat absorption sides of the thermoelectric module type condenser plates 45*a* is directed to the heat dissipation sides. The circulation air passing by the heat dissipation sides of the thermoelectric module type condenser plates 45*a* flows toward the heater 47.

For this, the circulation duct 46 includes a first connecting part 46*a* which connects a front side of the drum 42 to the thermoelectric module type condenser 45 so that the air exhausted from the drum 42 can pass by the heat absorption sides of the condenser 45, a second connecting part 46*b* which connects one side (an outlet of a condensing passage) of the condenser 45 to the other side (an inlet of a cooling passage) of the condenser 45 so that the circulation air passing by the heat absorption sides of the condenser 45 can be directed toward the heat dissipation sides of the condenser 45, and a third connecting part 46*c* which connects the other side of the condenser 45 to a rear side of the drum 42.

A water-receiving member (not shown) for gathering the dropped condensed water and a pump for forcedly discharging the condensed water from the water-receiving member or transferring the condensed water to a water bucket (not shown) mounted in the main body 40 may be mounted under the thermoelectric module type condenser 45. A lint filter for filtering a substance like waste thread or fluff from the air exhausted into the circulation duct 46 from the front side of the drum 42 may be provided.

Control process of the clothes dryer according to the fifth embodiment of the present invention will now be described.

After putting the objects to be dried (e.g., the wet clothes) into the drum 42, if starting the operation by selecting a drying mode, the motor 43 and the heater 47 are driven to rotate the circulation fan 48 and the drum 42. At this time, the cooling fan driving motor(not shown) does not operate.

The air flows through the circulation duct 46, and is heated to high temperature by the heater 47. The heated air flows into the drum 42.

If a preset time X elapses or the temperature of the circulation air in the drum 42 and the circulation duct 46 rises to a target value T, the thermoelectric module type condenser 45 is turned on.

The air of high temperature and humidity after drying the wet objects in the drum 42 passes by the heat absorption sides of the thermoelectric module type condenser 45 and is dried by being condensed by heat exchange with the heat absorption sides.

The circulation air passing by the heat absorption sides of the thermoelectric module type condenser 45 flows between the condenser plates 45*a* by being guided by the second connecting part 46*b* of the circulation duct 46. The circulation air passes by the heat dissipation sides of the thermoelectric module type condenser 45, and is directed toward the heater 47. Then, the circulation air is heated by the heater 47 and enters the drum 42.

In this embodiment, a point of time when turning on the thermoelectric module type condenser 45 may be controlled by the preset time X stored in a controller based upon experiments of measuring time until the temperature of the circulation air flowing in the drum 42 rises to the target value T or by disposing a temperature sensor (not shown) in the drum 42 or the circulation duct 46 to detect whether the temperature of the circulation air rises to the target value T.

It has been described that the clothes dryer according to the fifth embodiment is structured such that the direction of the air passing by the heat absorption sides of the thermoelectric module type condenser 45 is perpendicular to the direction of the air passing by the heat dissipation sides of the thermoelectric module type condenser 45, however, this is not restricted thereto.

Figure 10:
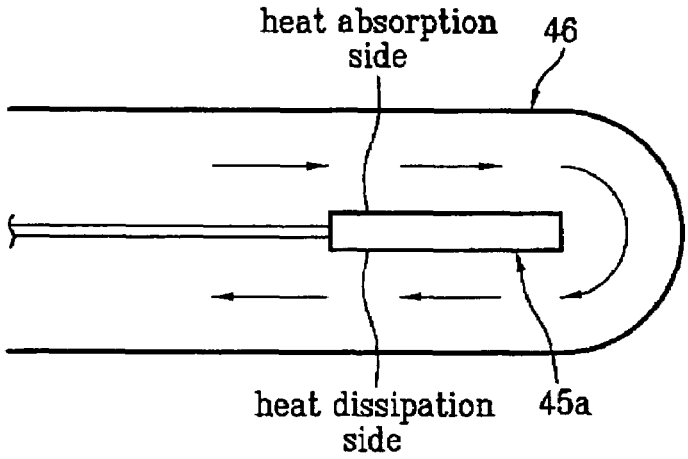
FIGS. 10 and 11 are longitudinal sectional views showing circulation ducts used in fourth, fifth and sixth embodiments in accordance with the present invention.
Figure 11:
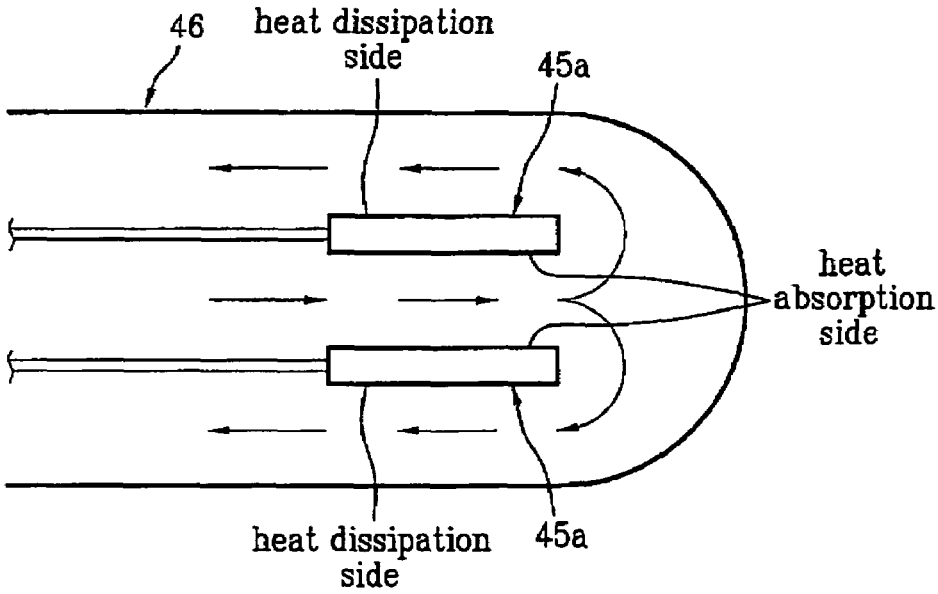

That is, as shown in FIGS. 10 and 11, circulation ducts 460 and 461 may be modified in structure so as to divert the air flow in the opposite (180 degree) direction. Accordingly, the circulation air of low temperature after being condensed can be preheated instead of cooling down the heat dissipation sides of the thermoelectric module type condenser plates 45*a*.

Though it is not illustrated in detail in FIGS. 10 and 11, the heat absorption sides of the thermoelectric module type condenser plates 45*a* may be slantedly mounted to easily gather the condensed water, and the gathered condensed water may be discharged from the circulation ducts 460 and 461 through a drain hose.

In order to modify the structure so that the circulation air of low temperature after being condensed can be preheated instead of cooling down the heat dissipation sides of the thermoelectric module type condenser plates 45*a*, by diverting the air flow in the opposite (180 degree) direction, the thermoelectric module should be designed to satisfy the condition that the temperature of the circulation air passing by the heat absorption sides of the thermoelectric module type condenser 45 is lowered below the temperature of the heat dissipation sides. Because the thermoelectric module has features that cooling speed is high, temperature is accurately adjusted, partial cooling and operation in all directions are achieved, and the heat absorption sides and the heat dissipation sides are easily changed into each other only by changing the direction of the current flow, the thermoelectric module can be variously designed corresponding to desired conditions.

Further, the thermoelectric module has no mechanical operation sound and vibration, does not use refrigerant (is environmentally friendly), and can be manufactured compactly.

As described above, the condensing clothes dryer according to the fifth embodiment of the present invention can solve the problem of the conventional condensing drying apparatus, of that because it is additionally equipped with a cooling water supply conduit or an outdoor air supply conduit for supplying cooling water or cold outdoor air for the condensation, the structure becomes complicated.

Hereinafter, a condensing clothes dryer according to a sixth embodiment of the present invention will be described with reference to FIG. 8.

A basic structure of a condensing clothes dryer according to this embodiment is similar to the structure of the condensing clothes dryer according to the fourth embodiment, except that the condensing clothes dryer according to this embodiment is additionally provided with a constitution for recycling a portion of outdoor air discharged after being used for cooling down the heat dissipation sides of the thermoelectric module type condenser 45. The explanation of the same elements as the condensing clothes dryer according to the fourth embodiment will be omitted.

Figure 8:
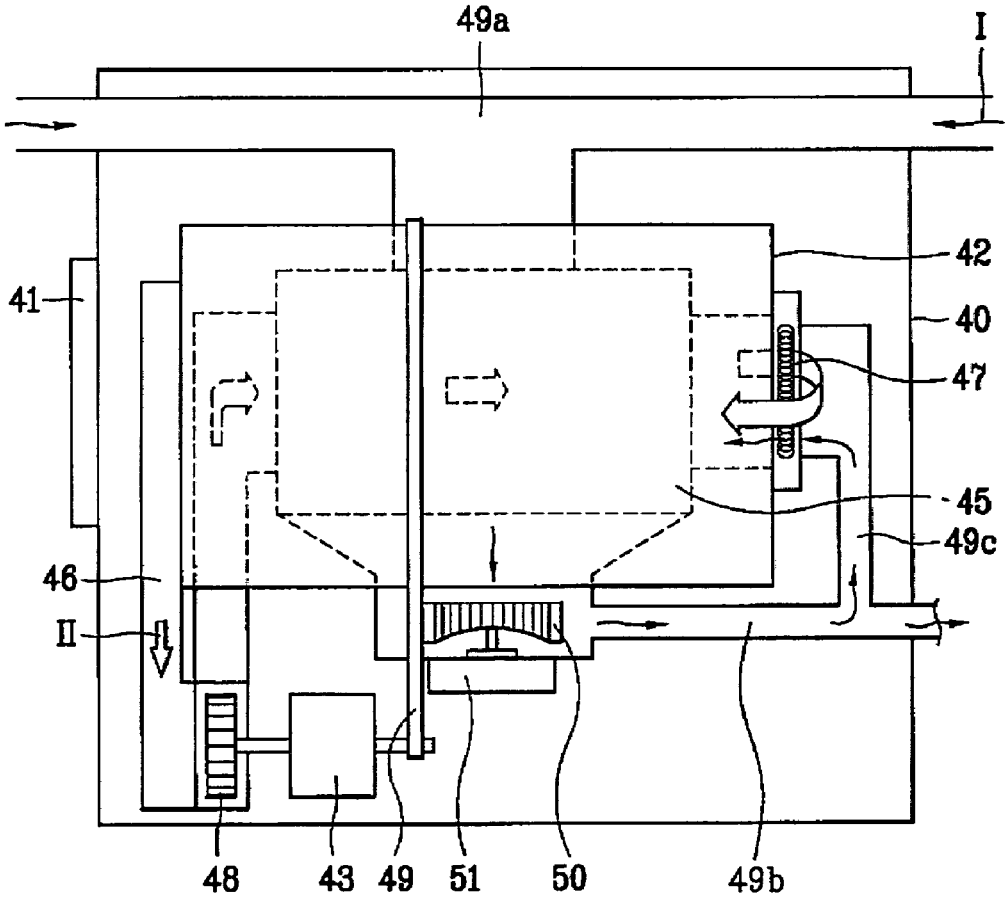
FIG. 8 is a constitutional view showing a sixth embodiment of a drying apparatus equipped with a thermoelectric module in accordance with the present invention.

As shown in FIG. 8, the condensing clothes dryer according to this embodiment includes a guide duct 49*c* through which a portion of the outdoor air discharged through an outdoor air-discharge pipe 49*b* joins the circulation air flowing toward a heater 47.

The cold outdoor air is supplied to the thermoelectric module type condenser 45 through an outdoor air-supply duct 49*a* and passes by the heat dissipation sides of the thermoelectric module type condenser 45 to cool down the same, and thus the condensing efficiency at the heat absorption sides is increased.

The outdoor air heated while cooling down the heat dissipation sides is discharged through the outdoor air-discharge pipe 49*b*, and a portion of the heated outdoor air flowing in the outdoor air-discharge pipe 49*b* is bypassed toward the heater 47 through the guide duct 49*c*, thereby reducing load of the heater 47.

Because the outdoor air has much lower relative humidity than the circulation air and a portion of the outdoor air heated by heat exchange with the heat dissipation sides of the condenser flows toward the heater 47, the load of the heater 47 can be reduced and the outdoor air lowers the relative humidity of the circulation air, thereby increasing the drying efficiency.

As apparent from the above description, according to the respective embodiments of the present invention, there are provided a drum washing machine and a clothes dryer of a new environmentally friendly condensation type which can increase drying efficiency and energy efficiency.

That is, the drying apparatus according to the respective embodiments of the present invention can increase the energy efficiency with minor structural modification and becomes environmentally friendly unlike the conventional drying apparatus using a heat pump.

Especially, according to the first embodiment of the present invention, there is provided a high-efficiency drying apparatus in which the supply of the cooling water for the condensation is unnecessary.

According to the second embodiment of the present invention, there is provided a high-efficiency drying apparatus in which the supply of the cooling water for the condensation is unnecessary and the cooling fan for cooling the heat dissipation side of the thermoelectric module is removed.

According to the third embodiment of the present invention, there is provided a drying apparatus having high energy efficiency, in which the supply of the cooling water for the condensation is unnecessary and the cooling fan or the cooling water-supply constitution for cooling the heat dissipation side of the thermoelectric module is removed.

According to the fourth embodiment of the present invention, there is provided an environmentally friendly drying apparatus which can increase energy efficiency with minor structural modification in comparison with the conventional drying apparatus.

According to the fifth embodiment of the present invention, there is provided an environmentally friendly and high-efficiency drying apparatus in which the cooling fan and the duct for supplying and discharging the outdoor air are removed.

According to the sixth embodiment of the present invention, there is provided an environmentally friendly drying apparatus having high energy efficiency, in which a portion of the outdoor air heated by heat exchange with the heat dissipation side of the thermoelectric module type condenser is bypassed toward the heater, thereby reducing the capacity of the heater and increasing the drying efficiency.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A clothes dryer comprising:

a drum into which objects to be dried are put;

a circulation duct which forms an air circulation passage so that air exhausted from the drum flows again into the drum;

a condenser which condenses the air exhausted from the drum, the condenser comprising a thermoelectric module having a heat absorption side and a heat dissipation side which absorbs and dissipates heat at a junction between two dissimilar metals depending on a direction of current flow through the junction, and the condenser is mounted so that the air exhausted from the drum passes by the heat absorption side of the thermoelectric module;

a heater which heats the air;

a circulation fan which forcedly circulates the air through the circulation duct;

an outdoor air-discharge duct which is connected to the condenser to discharge the outdoor air passing by the heat dissipation sides of the condenser; and a guide duct which is connected to the outdoor-discharge duct to bypass a portion of the outdoor air discharged through the outdoor-discharge duct toward the heater.

2. The clothes dryer according to claim 1, wherein the air passing by the heat absorption side flows into the drum via the heat dissipation side of the thermoelectric module.

3. The clothes dryer according to claim 1, wherein the thermoelectric module comprises a plurality of thermoelectric modules which are arranged in a multi-layer structure with a gap therebetween, and wherein the thermoelectric modules respectively include at least one pair of heat absorption sides which oppose each other.

4. The clothes dryer according to claim 3, wherein the air passing by a space between the heat absorption sides flows into the drum via heat dissipation sides of the thermoelectric modules.

5. The clothes dryer according to claim 1, further comprising:

an outdoor air-supply duct which is connected to the condenser to supply outdoor air so that the outdoor air passes by the heat dissipation side of the condenser;

a cooling fan which is mounted on the outdoor air-supply duct or the outdoor air-discharge duct to suck and discharge the outdoor air; and a variable speed motor which drives the cooling fan.

6. The clothes dryer according to claim 1, wherein the heater is capable of changing a heat release rate.

7. The clothes dryer according to claim 2, wherein the heater is capable of changing a heat release rate.

8. The clothes dryer according to claim 3, wherein the heater is capable of changing a heat release rate.

9. The clothes dryer according to claim 4, wherein the heater is capable of changing a heat release rate.

10. The clothes dryer according to claim 5, wherein the heater is capable of changing a heat release rate.

* * * * *